United States Patent [19]

Shimamura et al.

[11] 4,146,397

[45] Mar. 27, 1979

[54] METHOD OF FORMING A PHOTOGRAPHIC IMAGE

[75] Inventors: Isao Shimamura; Hiroshi Hara, both of Minami-ashigara, Japan

[73] Assignee: Fuji Photo Film Co., Ltd., Minami-ashigara, Japan

[21] Appl. No.: 822,862

[22] Filed: Aug. 8, 1977

[30] Foreign Application Priority Data

Aug. 6, 1976 [JP] Japan ..... 51/94376

[51] Int. Cl.[2] ..... G03C 5/32; G03C 7/00; G03C 1/72

[52] U.S. Cl. ..... 96/60 R; 96/56; 96/114

[58] Field of Search ..... 423/272, 273, 584; 96/60, 56

[56] References Cited

U.S. PATENT DOCUMENTS

| | | | |
|---|---|---|---|
| 3,201,246 | 8/1965 | Allen et al. | 96/66.4 |
| 3,617,282 | 11/1971 | Bard et al. | 96/22 |
| 3,681,022 | 8/1972 | Kibbel et al. | 423/584 |
| 3,687,627 | 8/1972 | Stalter | 423/584 |
| 4,045,226 | 8/1977 | Hara et al. | 96/60 R |

FOREIGN PATENT DOCUMENTS

| | | | |
|---|---|---|---|
| 1045373 | 12/1958 | Fed. Rep. of Germany | 96/66.4 |

*Primary Examiner*—Mary F. Kelley
*Attorney, Agent, or Firm*—Sughrue, Rothwell, Mion, Zinn and Macpeak

[57] ABSTRACT

A method of forming a photographic image which comprises image-wise exposing a silver halide photographic element containing at least one compound having a degree of polymerization of about 10 to about 8,000 and represented by the following general formula (I):

$$-A)_x(B)_y \qquad (I)$$

wherein

A represents

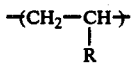

or $-(CH_2-CH_2-O)-$, R represents

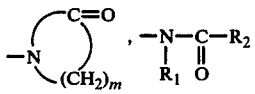

or —OH, m is an integer of 3 to 7, $R_1$ represents an alkyl group having 1 to 6 carbon atoms, and $R_2$ represents a hydrogen atom or an alkyl group having 1 to 4 carbon atoms;

B represents a monomer unit derived from styrene, methacrylic acid ester, acrylic ester, vinyl acetate, acrylonitrile, vinyl alcohol, vinyl chloride, vinyl ether, acrylamide, N,N-dimethylacrylamide, acrylic acid, methacrylic acid, maleic acid, potassium styrenesulfonate, N,N-dialkylaminoalkyl methacrylate, vinylimidazole or vinylpyridine; and x and y represent the mole%, respectively, of A and B, with $x + y = 100$ and in which $x \geqq 30$;

and then subjecting the silver halide photographic element to an image-intensifying in the presence of a reducing agent using a solution containing (1) at least one peroxide selected from the group consisting of hydrogen peroxide and compounds capable of releasing hydrogen peroxide and (2) at least one organic phosphonic acid compound.

10 Claims, No Drawings

METHOD OF FORMING A PHOTOGRAPHIC IMAGE

BACKGROUND OF THE INVENTION

1. Field of the Invention

This invention relates to a method of forming photographic images which comprises intensifying with hydrogen peroxide or compounds capable of releasing hydrogen peroxide. More particularly, this invention relates to an image-forming method which can be used to restrain fog which will occur in the course of intensification, to diminish the influence of intensification inhibitors, and to remarkably increase the intensification effect and maintain the effect in a stable manner.

2. Description of the Prior Art

Many methods of enhancing the image density by development and then intensification of silver halide photosensitive materials are known.

Formation of dyes by the oxidation of a p-phenylenediamine color developing agent due to the decomposition of hydrogen peroxide on the surface of silver catalysts in the presence of a color coupler and subsequent coupling with the color coupler (this phenomenon is referred to herein as "color intensification") has been described in, e.g., Friedman, *History of Color Photography,* p. 406, 2nd Ed., (1956).

Furthermore, other various photographic methods which take advantage of the decomposition of peroxides on the surface of noble metals have been described in, e.g., German Patent Applications (OLS) Nos. 1,950,102, 1,955,901, 2,044,833, 2,044,993 and 2,120,091 and U.S. Pat. Nos. 3,674,490, 3,684,511, 3,776,730 and 3,765,890.

Further, descriptions of intensification using cobalt complex salts on the surface of noble metals are found in, e.g., Japanese Patent Applications (OPI) Nos. 9,728/73 (corresponding to U.S. Pat. No. 3,834,907), 9,729/73 (corresponding to U.S. Pat. No. 3,765,891), 48,130/73 (corresponding to U.S. Pat. No. 3,822,129), 84,229/74, 84,239/74, 84,240/74 (corresponding to U.S. Pat. No. 3,902,905), 97,614/74 (corresponding to U.S. Pat. No. 3,847,619), 102,340/74 (corresponding to U.S. Pat. No. 3,923,511) and 102,341/74 (corresponding to U.S. Pat. No. 3,856,524).

Moreover, color intensification using halogen acids such as salts of chlorous acid has been described in Japanese Patent Application (OPI) No. 53,826/76 and Japanese Patent Application No. 139,917/74.

Compounds providing an intensifying effect such as the above described peroxides, halogen acids and cobalt (III) complex compounds are referred to an intensifying agents, and processing baths containing these intensifying agents are referred to as intensifying baths.

In color photographic processes with which this invention is concerned, a color photographic material prepared by incorporating cyan, yellow, magenta or other color couplers in silver halide emulsions using various techniques and coating the emulsions on a support is image-wise exposed to light and then subjected to a series of processings to reproduce an image in the photographic material.

The basic processing steps involved in color photographic processing are a color developing step and a silver-removing step. In the color developing step, silver halide containing in the exposed silver halide color photographic material is reduced by a color developing agent to produce a silver image, while the color developing agent is correspondingly oxidized. The oxidized color developing agent reacts with a color coupler to produce a dye image. Then, the color photographic material is subjected to a silver-removing step. In this step, silver which is produced in the prior step, i.e., the color developing step, is oxidized by an oxidizing agent (which is commonly called a "bleaching agent") to silver ion. Thereafter, the photographic material is subjected to a fixing step. In the fixing step, silver ions are dissolved using a complexing agent for silver ions which is commonly called a fixing agent to remove silver from the photographic material. The photographic material which is treated through the above processing steps forms only a dye image. Practical development processing involves the above two basic steps, i.e., the color developing and silver-removing steps, as well as auxiliary steps for maintaining the photographic and physical qualities of the image or improving the storage stability of the image. For example, auxiliary steps include hardening baths for preventing an excess softening of photosensitive layers during processings, stopping baths for effectively stopping the development reaction, image-stabilizing baths for stabilizing the image formed, film-stripping baths for removing a backing layer of the support, etc.

This type of processing of color photographic materials has been usually practiced in the photographic art throughout the world since the 1940's.

The above-described color intensifying methods must provide the same dye density as is obtained when the conventional method is used. Thus, a rapid oxidation of a reducing agent such as a color developing agent must occur on the surface of a small amount of metallic silver catalysts comprising development nuclei in the silver halide grains or developed silver. Therefore, enhancing the activity of the processing bath containing an intensifying agent is desirable, and as to the reducing agents such as color developing agents, those having a higher activity as described in Japanese Patent Application No. (OPI) 11,534/72 (corresponding to U.S. Pat. No. 3,656,950) are preferred to conventional color developing agents.

When the above-described intensifying method with high activity is applied to photographic photosensitive materials containing silver halide as a photosensitive material, color formation occurs also in the unexposed areas in the intensifying bath, resulting in fog (which is referred to as "color intensification fog"). This is an important problem in practical application of intensifying methods.

As one method of restraining fog which is formed during the intensifying step, incorporation of an anti-foggant in the intensifying bath has been attempted. However, the addition of potassium bromide, sodium bromide or the like remarkably inhibits the intensifying action obtained. Also, organic anti-foggants having strong adsorption properties (i.e., compounds containing a mercapto group) remarkably inhibit intensification. On the other hand, compounds having weak adsorption properties (e.g., 6-nitrobenzimidazole) are effective, but if they are added in amounts of more than 1 g/liter, intensification is inhibited to a considerable extent.

Moreover, in using intensifying baths containing peroxides as an intensifying agent, the intensifying effect is remarkably inhibited since potassium bromide which is added as an anti-foggant to a developer and bromide or iodide ions which are released during development of the silver halide enter the intensifying bath.

Further, peroxides, typically hydrogen peroxide, are very unstable in aqueous solutions. In particular, when a developer is mixed with the intensifying bath (e.g., carried over into the intensifying bath), decomposition of hydrogen peroxide occurs in a very short time, resulting in a loss of the image-intensifying action.

Stabilization of an aqueous hydrogen peroxide solution can be achieved by adding a stabilizer such as sodium pyrophosphate or sodium stannate, e.g., as described in, *Research Disclosure,* 11660; W. C. Schumb, *Hydrogen Peroxide,* pp. 515–547; etc. However, even the addition of sodium pyrophosphate or sodium stannate is not sufficient to stabilize intensifying baths containing hydrogen peroxide which are contaminated with a developer. The contamination of an intensifying bath with a developer is an essential problem in the image-intensifying method using peroxides. This contamination is inevitable because photosensitive materials are developed and subsequently, without washing or after rinsing for a short time, are treated with an intensifying bath.

Another problem of practical importance is color mixing. Intensifying baths containing peroxides as an intensifying agent cause marked color mixing with the lapse of time after a developer is mixed therein. This color mixing is referred to as color mixing between the layers. Because color formation occurs not only in the layer in which color formation is originally intended but also in another layer (mainly in an adjacent layer) or layers, the purity of the colors is decreased. Therefore, this color mixing is one of the causes for the marked deterioration of image qualities. While not desiring to be bound, color mixing is, it is believed, caused by a reaction of the color developing agent which is mixed into the intensifying bath with the peroxide to produce an oxidized form of the developing agent, the thus produced oxidized form of the developing agent exerting a direct action or an indirect action (the action of a reaction product formed from the oxidized developing agent and other components). Contamination of the intensifying bath with a developer is inherent in image-intensification and, therefore, it is extremely difficult to avoid this problem.

Even when alkylhydroquinone derivatives are incorporated in an intermediate layer, which is a known technique, color mixing due to intensification cannot be prevented.

SUMMARY OF THE INVENTION

An object of this invention is to provide an improvement in the method of forming images which comprises intensifying with hydrogen peroxide or compounds capable of releasing hydrogen peroxide.

More particularly, a first object of this invention is to provide an image-forming method in which photosensitive materials suitable for image-intensification are used.

A second object of this invention is to provide an image-forming method in which the formation of color intensification fog is restrained, the influence of intensification inhibitors is diminished and in which a high intensifying effect is obtained.

A third object of this invention is to improve the stability of intensifier baths and, more particularly, to prevent the decomposition of hydrogen peroxide due to the mixing of a developer into the intensifier.

A fourth object of this invention is to provide an image-forming method in which color mixing due to image-intensification is prevented and, more particularly, to provide an image-forming method which prevents color mixing between layers which may be caused by using an intensifying bath contaminated with a developer.

A fifth object of this invention is to provide an image-forming method which uses a photographic element in which the amount of silver present is reduced comprising image-forming unit layers containing photosensitive silver halide in an amount less than a stoichiometric amount in combination with a sufficient amount of a color coupler and in which color intensification fog and color mixing are prevented, the influence of intensification inhibitors is diminished and treatment showing high intensifying effect can be performed in a stable manner.

The various objects of this invention can be achieved by the following method.

This invention thus provides an image-forming method which comprises image-wise exposing a silver halide photographic element containing at least one compound having a degree of polymerization of about 10 to about 8,000 and represented by the following general formula (I):

$$\text{-}(A)_x(B)_y\text{-} \qquad \text{(I)}$$

wherein

A represents

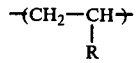

or $\text{-}(CH_2\text{—}CH_2\text{-}O)\text{-}$, R represents

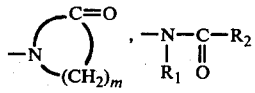

or —OH, m is an integer of 3 to 7, $R_1$ represents an alkyl group having 1 to 6 carbon atoms, $R_2$ represents a hydrogen atom or an alkyl group having 1 to 4 carbon atoms;

B represents a monomer unit derived from styrene, methacrylic acid ester, acrylic ester, vinyl acetate, acrylonitrile, vinyl alcohol, vinyl chloride, vinyl ether, acrylamide, N,N-dimethylacrylamide, acrylic acid, methacrylic acid, maleic acid, potassium styrenesulfonate, N,N-dialkylaminoalkyl methacrylate, vinylimidazole or vinylpyridine; and x and y represent the mole%, respectively, of A and B, with $x + y = 100$ and in which $x \geqq 30$;

and then subjecting the silver halide photographic element to an image-intensifying in the presence of a reducing agent using a solution containing (1) at least one peroxide selected from the group consisting of hydrogen peroxide and compounds capable of releasing hydrogen peroxide, and (2) at least one organic phosphonic acid compound.

DETAILED DESCRIPTION OF THE INVENTION

All the objects of this invention are achieved by the above-described method of this invention. A most important feature of this invention is the use in combination of (1) at least one compound represented by the above general formula (I) incorporated in a silver halide photographic element with (2) at least one organic phosphonic acid compound incorporated in the intensifier containing a peroxide. By using the above combination of (1) with (2), an unexpected effect of preventing color mixing has been found.

Color mixing is marked when a developer is mixed into the intensifying bath containing a peroxide. This color mixing is called color mixing between layers and refers to the phenomenon in which color formation occurs not only in the layer in which the color formation is originally intended but also in adjacent layers.

In using a silver halide photographic element which does not contain therein a compound represented by the above general formula (I), the effect of preventing color mixing is not produced even when the photographic element is treated with an intensifying bath containing a peroxide and an organic phosphonic acid compound. Moreover, when a photographic element containing a compound represented by the above general formula (I) is treated with an intensifying bath containing a peroxide but not containing an organic phosphonic acid, the effect of preventing color mixing is also not produced. Furthermore, when in the method of this invention as described above is conducted except sodium pyrophosphate or sodium stannate is used in place of the organic phosphonic acid, the effect of preventing color mixing is also not produced. Further, the addition of hydroquinone derivatives, which is a known technique, to an intermediate layer is also ineffective for prevention of color mixing.

One preferred embodiment of this invention is an image-forming method which comprises image-wise exposing a silver halide photographic element containing at least one compound having a degree of polymerization of about 10 to about 8,000 and represented by the above-described general formula (I) and then image-intensifying the photographic element in the presence of a reducing agent and a color coupler using a solution containing (1) at least one peroxide selected from the group consisting of hydrogen peroxide and compounds capable of releasing hydrogen peroxide and (2) at least one organic phosphonic acid compound.

A more preferred embodiment of this invention is an image-forming method in which a color photographic element containing color couplers is used as the silver halide photographic element.

Specific examples of the compounds of the general formula (I) which can be used in this invention are given below. However, the present invention is not to be construed as being limited to these specific examples.

| | | |
|---|---|---|
| (1) | 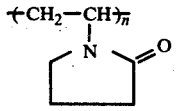 | (n: 100 - 150) |
| (2) | 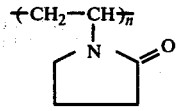 | (n: 300 - 500) |
| (3) | 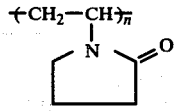 | (n: 2,000 - 3,000) |
| (4) | 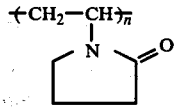 | (n: 5,000 - 8,000) |
| (5) | 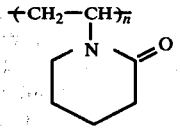 | (n: 2,000 - 3,000) |
| (6) | 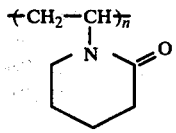 | (n: 300 - 500) |
| (7) | 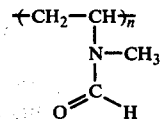 | (n: 2,000 - 3,000) |
| (8) | 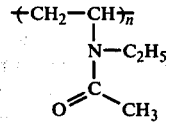 | (n: 2,000 - 3,000) |
| (9) | 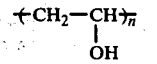 | (n: 10,000 - 25,000) |
| (10) | 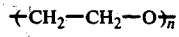 | (n: 5,000 - 8,000) |

-continued

| | | |
|---|---|---|
| (11) | $\leftarrow CH_2-CH\rightarrow_{70}\leftarrow CH_2-CH\rightarrow_{30}$ (N, O, OH) | (degree of polymerization: 200 - 250) |
| (12) | $\leftarrow CH_2-CH\rightarrow_{60}\leftarrow CH_2-CH\rightarrow_{40}$ (N, O, $OCOCH_3$) | (degree of polymerization: 500 - 550) |
| (13) | $\leftarrow CH_2-CH\rightarrow_{70}\leftarrow CH_2-C(CH_3)\rightarrow_{30}$ (N, O, $COOCH_2CH_2OH$) | (degree of polymerization: 250 - 300) |
| (14) | $\leftarrow CH_2-CH\rightarrow_{50}\leftarrow CH_2-CH\rightarrow_{50}$ (N, O, $COOCH_3$) | (degree of polymerization: 300 - 350) |
| (15) | $\leftarrow CH_2-CH\rightarrow_{50}\leftarrow CH_2-CH\rightarrow_{50}$ (N, O, C6H5) | (degree of polymerization: 450 - 500) |
| (16) | $\leftarrow CH_2-CH\rightarrow_{50}\leftarrow CH_2-CH\rightarrow_{50}$ (N, O, CN) | (degree of polymerization: 450 - 500) |
| (17) | $\leftarrow CH_2-CH\rightarrow_{50}\leftarrow CH_2-CH\rightarrow_{50}$ (N, O, $CONH_2$) | (degree of polymerization: 200 - 250) |
| (18) | $\leftarrow CH_2-CH\rightarrow_{50}\leftarrow CH_2-CH\rightarrow_{50}$ ($N-C_2H_5$, $COOCH_3$, O, C, $CH_3$) | (degree of polymerization: 350 - 400) |

Compounds of the general formula (I) are known and described in, e.g., U.S. Pat. Nos. 3,730,726, 3,770,450, 3,813,250 and 3,713,829, German Pat. No. 1,772,074, etc.

Organic phosphonic acid compounds which can be used in this invention are organic compounds containing, in the structure, at least one $PO_3M_2$ group (wherein M represents a hydrogen atom or a cation which imparts water-solubility, e.g., alkali metal cations such as sodium ion or potassium ion; ammonium ion; pyridinium ion; triethanolammonium ion; triethylammonium ion; etc.). The organic phosphonic acid compounds are considered water-soluble if they have a solubility of not less than about 5 g. in 100 cc of water at 25° C. Preferred compounds are represented by the following general formula (II) or (III).

$$R_1N(CH_2PO_3M_2)_2 \quad \text{(II)}$$

In the above general formula (II), M represents a hydrogen atom or a cation which imparts water-solubility (e.g., alkali metal ions such as sodium ion or potassium ion; ammonium ion; pyridinium ion; triethanolammonium ion; triethylammonium ion; etc.). $R_1$ represents an alkyl group having 1 to 4 carbon atoms (such as a methyl, ethyl, propyl, isopropyl or butyl group); an aryl group (such as a phenyl, o-tolyl, m-tolyl, p-tolyl, p-carboxyphenyl group or a water-soluble salt (such as the sodium or potassium salt) of a p-carboxyphenyl group); an aralkyl group (such as a benzyl, β-phenethyl or o-acetamidobenzyl group, with a particularly preferred aralkyl group being one having 7 to 9 carbon atoms); an alicyclic group (e.g., a 5- or 6-membered alicyclic group such as a cyclohexyl or cyclopentyl group); or a heterocyclic group (e.g., a 5- or 6-membered heterocyclic group such as a pyridyl, pyrrolidylmethyl, pyrrolidylbutyl, benzothiazoylmethyl or tetrahydroquinolylmethyl group). $R_1$ can be substituted, particularly desirably when $R_1$ represents an alkyl group, with one or more of a hydroxyl group, an alkoxy group (e.g., having 1 to 4 carbon atoms such as a methoxy or ethoxy group), a halogen atom (such as a chlorine atom, a bromine atom, a fluorine atom), $-PO_3M_2$, $-CH_2PO_3M_2$ or $-N(CH_2PO_3M_2)_2$ (wherein M has the same meaning as described above).

$$R_2R_3C(PO_3M_2)_2 \quad \text{(III)}$$

In the above general formula (III), $R_2$ represents a hydrogen atom, or an alkyl group, an aralkyl group, an alicyclic group or a heterocyclic group as defined for $R_1$ above, $-CHR_4-PO_3M_2$ (wherein $R_4$ represents a hydrogen atom, a hydroxy group or an unsubstituted alkyl group having 1 to 4 carbon atoms) or $-PO_3M_2$. $R_3$ represents a hydrogen atom, a hydroxyl group, an alkyl group, a substituted alkyl group as defined for $R_1$ above or $-PO_3M_2$ (wherein M has the same meaning as described above). Of the above compounds, the compounds of the general formula (II) are particularly advantageous.

Examples of phosphonic acid compounds which can be used in this invention are given below. However, the present invention should not be construed as being limited to these specific examples.

Examples of compounds represented by the general formula (II) above are shown below.

(A) Ethylenediamine-N,N,N',N'-tetramethylenephosphonic acid
(B) Nitrilo-N,N,N-trimethylenephosphonic acid
(C) 1,2-Cyclohexanediamine-N,N,N',N'-tetramethylenephosphonic acid
(D) o-Carboxyaniline-N,N-dimethylenephosphonic acid
(E) Propylamine-N,N-dimethylenephosphonic acid
(F) 4-(N-Pyrrolidino)butylamine-N,N-bis(methylenephosphonic acid)
(G) 1,3-Diaminopropanol-N,N,N',N'-tetramethylenephosphonic acid
(H) 1,3-Propanediamine-N,N,N',N'-tetramethylenephosphonic acid
(I) 1,6-Hexanediamine-N,N,N',N'-tetramethylenephosphonic acid
(J) o-Acetamidobenzylamine-N,N-dimethylenephosphonic acid
(K) o-Toluidine-N,N-dimethylenephosphonic acid
(L) 2-Pyridylamine-N,N-dimethylenephosphonic acid Examples of compounds represented by the general formula (III) above are shown below.

(M) 1-Hydroxyethane-1,1-diphosphonic acid
(N) Ethane-1,1,1-triphosphonic acid
(O) 1-Hydroxy-2-phenylethane-1,1-diphosphonic acid
(P) 2-Hydroxyethane-1,1-diphosphonic acid
(Q) 1-Hydroxyethane-1,1,2-triphosphonic acid
(R) 2-Hydroxyethane-1,1,2-triphosphonic acid
(S) Ethane-1,1-diphosphonic acid
(T) Ethane-1,2-diphosphonic acid The amount of the compound of the formula (I) above which is used in this invention is preferably about 1 mg to about 10 g, particularly 10 mg to 200 mg, per $m^2$ of the photographic element.

The amount of the organic phosphonic acid compounds which is used in this invention is about 10 mg to about 50 g, preferably 100 mg to 20 g, per liter of the intensifier.

Hydrogen peroxide or compounds capable of releasing hydrogen peroxide are used as an intensifying agent in this invention. Compounds capable of releasing hydrogen peroxide include, e.g., perhydrates such as $Na_2SiO_3.H_2O_2.H_2O$ or $NaBO_2.H_2O_2.3H_2O$, peroxo compounds such as peroxocarbonates peroxoborates, peroxosulfates or peroxophosphates, etc.

Hydrogen peroxide or the compounds capable of releasing hydrogen peroxide are used in amounts of about 1 g/liter to about 300 g/liter in the intensifier and, particularly, an amount ranging from 2 g/liter to 100 g/liter is preferred.

The intensifier contains an oxidizing agent and the pH of the intensifier ranges from about 7 to about 14, preferably 8 to 11. A pH range of 9.5 to 10.5 is particularly preferred.

The intensifier can further contain known developer solution components. For example, as alkali agents, buffering agents, or the like, sodium hydroxide, potassium hydroxide, sodium carbonate, potassium carbonate, trisodium phosphate, tripotassium phosphate, potassium metaborate, borax and the like can be used individually or as a combination thereof. Moreover, in order to provide a buffering ability, for convenience in preparation or for increasing the ionic strength, various salts such as disodium hydrogen phosphate, dipotassium hydrogen phosphate, potassium dihydrogen phosphate, sodium dihydrogen phosphate, sodium hydrogencarbonate, potassium hydrogencarbonate, boric acid, alkali metal nitrates or alkali metal sulfates can be used.

Any anti-foggants can be incorporated in the intensifier, if desired. Anti-foggants which can be used include alkali metal halides such as potassium bromide, sodium bromide or potassium iodide and organic anti-foggants. Examples of organic anti-foggants include nitrogen-containing heterocyclic compounds such as benzotriazole, 6-nitrobenzimidazole, 5-nitroisoindazole, 5-methylbenzotriazole, 5-nitrobenzotriazole or 5-chlorobenzotriazole; mercapto-substituted heterocyclic compounds such as 1-phenyl-5-mercaptotetrazole, 2-mercaptobenzimidazole or 2-mercaptobenzothiazole; and mercapto-substituted aromatic compounds such as thiosalicyclic acid. Nitrogen-containing heterocyclic compounds are particularly preferred and nitrogen-containing heterocyclic compounds which are not substituted with a mercapto group are even more preferred. A suitable amount ranges from about 1 mg to about 5 g, preferably 5 mg to 1 g, per liter of the intensifier.

Examples of nitrogen-containing heterocyclic compounds which are free of mercapto group substitution are described in, e.g., the following literature references: nitrobenzimidazoles as described in, e.g., U.S. Pat. No. 2,496,940, British Pat. No. 403,789, U.S. Pat. Nos. 2,497,917 and 2,656,271, etc.; benztriazoles as described in *Journal of Japan Photographic Association,* 11, p. 48 (1948); heterocyclic quaternary salts such as benzthiazolium salts as described in, e.g., U.S. Pat. Nos. 2,131,038, 2,694,716 and 3,326,681, etc.; tetrazaindenes as described in U.S. Pat. Nos. 2,444,605, 2,444,606 and 2,444,607, etc.; other heterocyclic compounds as described in U.S. Pat.. Nos. 2,173,628, 2,324,123 and 2,444,608, etc.; and those compounds as described in *Manual of Scientific Photography,* Vol. 2, p. 119, Maruzen, Tokyo (1959).

Further, hydroxylamine sulfate or hydrochloride, sodium sulfite, potassium sulfite, potassium hydrogensulfite or sodium hydrogensulfite can be added to the intensifier.

The compounds described in W. C. Schumb et al., *Hydrogen Peroxide,* pp. 515–547 can be added to the intensifier as stabilizers for increasing the stability of peroxides present.

Any development accelerators can be added to the intensifier, if desired. Suitable development accelerators include various pyridinium compounds and other cationic compounds, typically those as described in U.S. Pat. No. 2,648,604, Japanese Patent Publication No. 9,503/69 and U.S. Pat. No. 3,671,247, cationic dyes such as phenosafranine, neutral salts such as thallium nitrate or potassium nitrate, polyethylene glycol and the derivatives thereof as described in Japanese Patent Publication No. 9,504/69 and U.S. Pat. Nos. 2,533,990, 2,531,832, 2,950,970 and 2,577,127, nonionic compounds such as polythioethers, organic solvents and organic amines as described in Japanese Patent Publication No. 9,509/69 and Belgian Pat. No. 682,862, ethanolamine, ethylenediamine, diethanolamine, etc. Accelerators described in L. F. A. Mason, *Photographic Processing*

*Chemistry,* pp. 40–43, Focal Press, London (1966) can also be used.

In addition, benzyl alcohol and phenylethyl alcohol as described in U.S. Pat. No. 2,515,147 and pyridine, ammonia, hydrazine and amines as described in *Journal of Japan Photographic Association,* 14, p. 74 (1952) are also effective development accelerators.

The reducing agents used in this invention are image-wise oxidized on the surface of the catalysts comprising exposed silver halide or developed silver by an activated oxidizing agent into which the intensifying agent is changed. A characteristic feature of the intensifying step is to take advantage of the phenomenon in which the intensifying agent is changed on the surface of silver catalysts into an agent having a strong oxidizing action. Examples of suitable reducing agents which can be used in this invention are, as a first example, those which are oxidized to form a dye themselves; as a second example, those which are oxidized and then oxidatively coupled with a color coupler having a coupling capability (couplers as described hereinafter) to form a dye; as a third example, those having a diffusible dye moiety which are image-wise oxidized to thereby be rendered non-diffusible; as a fourth example, those containing a non-diffusible color coupler moiety having a coupling capability which are image-wise oxidized to release a diffusible coupler; etc. In particular, reducing agents which are oxidatively coupled with a coupler to form a dye are preferred. In this case, dyes can be formed only in the presence of both of the reducing agent and the color coupler. In other cases, color images can be formed by the reducing agent alone.

The reducing agents which can be used in this invention include, e.g., p-phenylenediamine derivative color developing agents, p-aminophenol derivative color developing agents capable of forming onium salts as described in U.S. Pat. No. 3,791,827, dye developing agents as described in U.S. Pat. No. 2,983,605, redox compounds of the diffisable-dye releasing (DDR) type as described in Japanese Patent Application (OPI) No. 33,826/73, developing agents which form a dye by reacting with an amidazone compound as described in, e.g., Japanese Patent Publication No. 39,165/73, reducing agents which themselves are oxidized to form a dye or lakes (such as tetrazonium salts, 2,4-diaminophenol, α-nitroso-β-naphthol or leuco dyes), reducing agents capable of forming a colored image after being oxidized as described in Japanese Patent Application (OPI) No. 6,338/72, pp. 9–13, etc. Of these compounds, reducing agents which are developing agents and which themselves are oxidized and then coupled with a color coupler to form a dye, those which themselves are oxidized to form a dye, those which are originally colored and release a non-diffusible dye by oxidation, etc., are also included.

The reducing agents used in this invention can be incorporated into a processing solution and/or a photosensitive material. The term "processing solution" as used herein means a developer and an intensifier. In incorporating the reducing agent into a photosensitive material, the reducing agent can be incorporated into a silver halide emulsion layer and/or an adjacent non-photosensitive photographic auxiliary layer. A suitable amount of the reducing agent can range from about 0.1 to about 100 g/l, preferably 1 to 50 g/l when such is incorporated into a processing solution.

Particularly preferred reducing agents which can be used in this invention are p-phenylenediamine derivative color developing agents. Preferred representative examples thereof are N,N-diethyl-p-phenylenediamine hydrochloride, 4-amino-3-methyl-N,N-diethylaniline hydrochloride, 4-amino-3-methyl-N-ethyl-N-laurylaniline, 4-[N-ethyl-N-(β-hydroxyethyl)amino]aniline sulfate, 4-amino-3-methyl-N-ethyl-N-(β-hydroxyethyl)aniline sulfate, 4-amino-3-methyl-N-ethyl-N-(β-methanesulfoamidoethyl)aniline sesquisulfate monohydrate described in U.S. Pat. No. 2,193,015, 4-amino-3-(β-methanesulfoamidoethyl)-N,N-diethylaniline sulfate described in U.S. Pat. No. 2,592,364, N,N-diethyl-p-phenylenediamine hydrochloride, 4-amino-3-methyl-N-ethyl-N-methoxyethylaniline as described in U.S. Pat. Nos. 3,656,950 and 3,816,134, 4-amino-3-methyl-N-ethyl-N-β-ethoxyethylaniline and 4-amino-3-methoxy-N-ethyl-N-β-butoxyethylaniline and the salts thereof (such as the sulfates, hydrochlorides, sulfites or p-toluenesulfonates). In addition, reducing agents described in *Manual of Scientific Photography,* Vol. 2, p. 72, Maruzen, Tokyo (1959) and L. F. A. Mason, *Photographic Processing Chemistry,* pp. 226–229, Focal Press, London, (1966) can be used. In using these reducing agents, the couplers are described in C. E. K. Mees and T. H. James, *The Theory of the Photographic Process,* Third Ed., pp. 387–392, Macmillan & Co., New York (1966) must be incorporated in the image-forming material or in the processing solution.

p-Aminophenol derivatives may also be used as the reducing agent. Also, in this case, image formation takes place in the presence of the above-described couplers. A representative example of a reducing agent of this type is p-aminophenol sulfate.

Suitable reducing agents which can be used also include those which are oxidized to form a color image themselves and those which form a complex with a metal salt. Examples of these types are the developing agents described in British Pat. No. 1,210,417, the tetazonium salts described in U.S. Pat. No. 3,655,382, 2,4-diaminophenol and α-nitroso-β-naphthol.

Some general examples of image-wise distributed materials having a catalytic action which are produced by image-wise exposure are latent images formed in silver salt photosensitive materials, development centers and developed silver which is in a partially or completely reduced state. Further, image-wise distributed metals of a noble metal element which are produced by the intensification of a latent image with a gold salt or a platinum salt, e.g., as disclosed in U.S. Pat. No. 3,390,998 and U.S. Defensive Publication No. T-869,012, can also be used. Moreover, silver images which are transferred from a photosensitive material to a receiving material using the silver salt diffusion-transfer method can be employed. Further, image-wise distributed metals which are produced by the intensification of a latent image formed on a photoconductive material, such as titanium oxide or zinc oxide, with a noble metal compound such as a silver salt or a gold salt can be used. Examples of silver salts and gold salts which can be used to intensify the latent image formed on a photoconductive material are $AgNO_3$ and $HAuCl_3$. Furthermore, metals having a valence of 0 or sulfides which are selected from metals of Group IB of the periodic table and metals of Group VIII of the periodic table can be employed. Examples of Group IB or Group VIII sulfides which can be used are CuS, $Ag_2S$, NiS and CoS. These catalysts are employed in the photographic materials. Of these materials, materials having a particularly effective catalytic action are platinum, palladium, copper, silver, gold, mercury, carbon, copper sulfide and silver sulfide. A suitable amount of the catalytic material ranges from about 1 mg to about 3 g per $m^2$.

The reducing agents are compounds which can be oxidized in the presence of image-wise distributed materials having a catalytic action by hydrogen peroxide or a compound capable of releasing hydrogen peroxide, such as percarbonates or perborates, but which can be oxidized only at a very slow rate in areas where materials having a catalytic action are not present. Also, the reducing agents are compounds which themselves oxidatively form an image or which form an image by the reaction of an oxidized form of the reducing agent with a color coupler.

Materials for usual photographic use, e.g., negative type photographic use, contain about 3 to about 10 $g/m^2$ (as silver) of silver salts and materials for photographic prints contain about 1 to about 4 $g/m^2$ of silver. However, in the photographic material to which this invention is applicable, the amount of silver coated can be less than about 5 $g/m^2$ and, particularly, less than 3 $g/m^2$ can be used. In the case of multilayer photographic photosensitive materials, the amount of silver coated is less than about 3 $g/m^2$, particularly from 1 $mg/m^2$ to 1 $g/m^2$, for each photosensitive layer.

Color couplers which can be used in this invention are compounds which react with an oxidized color developing agent to form a dye. Color couplers include, e.g., couplers used in conventional color photosensitive materials, such as open-chain keto-methylene couplers, 5-pyrazolone couplers, indazolone couplers, phenol couplers and naphthol couplers; diffusable dye releasing (DDR) couplers which react with a color developing agent to release a diffusible dye, as described in British Pat. No. 840,731, U.S. Pat. No. 3,227,550, Japanese Patent Application (OPI) No. 123,022/74 and Japanese Patent Application No. 57,040/75; amidrazone compounds which react with an oxidized product of a developing agent to release a diffusible dye, as described in Japanese Patent Publication No. 39,165/73; etc.

In representative examples of photosensitive materials to which this invention is applicable, in which so-called couplers are incorporated as color couplers in the photosensitive material, the amounts of the couplers must be sufficient to provide sufficient color density. Therefore, the couplers are incorporated usually in excess of that equimolar to the silver present. Any known couplers can be used.

A compound capable of reacting with an oxidized developing agent to form a dye, i.e., a so-called coupler is incorporated in a photosensitive photographic emulsion layer used as a color photographic photosensitive material. The structure of these couplers is such that the couplers do not diffuse into other layers during preparation and processings.

More specifically, suitable couplers which can be used in this invention include the following couplers. Open-chain ketomethylene compounds are generally used as yellow couplers. Suitable examples of yellow couplers are described in, for example, U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194, German Patent Applications (OLS) Nos. 2,057,941, 2,213,461, 2,219,917, 2,261,361 and 2,263,875, etc.

5-Pyrazolone compounds are mainly used as magenta couplers, but indazolone compounds and cyanoacetyl compounds can also be used. Examples of these couplers are described in, for example, U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Applications Nos. 21,454/73 and 56,050/73, German Pat. No. 1,810,464, Japanese Patent Publication No. 2,016/69, German Patent Application (OLS) No. 2,418,959, U.S. Pat. No. 2,983,608, etc.

Phenol or naphthol derivatives are mainly used as cyan couplers and examples of these couplers are described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971 and 3,933,500, German Patent Application (OLS) No. 2,163,811 and Japanese Patent Publication No. 28,836/70.

Couplers which release a development inhibitor in the color-forming reaction (the so-called DIR couplers) or compounds which release a compound having a development-inhibiting action can also be employed. Examples of these compounds are described in U.S. Pat. Nos. 3,148,062, 3,227,554, 3,253,924, 3,617,291, 3,622,328 and 3,705,201, British Pat. No. 1,201,110, U.S. Pat. Nos. 3,297,445, 3,379,529 and 3,639,417.

The above-described couplers can be used as a combination of two or more thereof in the same layer in order to achieve the characteristics required of the photosensitive material, and the same compound can, of course, be incorporated in two or more different layers, if desired. A suitable amount of the color coupler can range from about 50 mg to about 3 $g/m^2$, preferably 100 mg to 2 $g/m^2$.

The color coupler incorporated in the unit layers, e.g., blue-sensitive unit, red-sensitive unit and green-sensitive unit layers, of the photosensitive element to which this invention is applicable is a water-insoluble color coupler which is mixed with a solvent for the color couplers (preferably a solvent for color couplers which has an appropriate polarity). Typical useful solvents include tri-o-cresyl phosphate, trihexyl phosphate, dioctylbutyl phosphate, dibutyl phthalate, diethyllaurylamide, 2,4-diallylphenol, the liquid dye stabilizers described in "Improved Solvents for Stabilizing Photographic Dye Images" in *Product Licensing Index*, 83, pp. 26–29, (March, 1971), etc. Regarding the photographic element containing a solvent for the color couplers, it seems that absorption of the color developer is accelerated during the processing step where the element is transferred from the developer bath into the intensifying bath.

It is preferred for the maximum absorption band of the cyan dye formed from a cyan color coupler to range from about 600 to 720 nm, that of the magenta dye formed from a magenta color coupler to range from about 500 to about 580 nm, and that of the yellow dye formed from a yellow color coupler to range from about 400 to about 480 nm.

The silver halide emulsions used in the photosensitive element to which this invention is applicable can be prepared by mixing a solution of a water-soluble silver salt (such as silver nitrate) with a solution of a water-soluble halide (such as potassium bromide) in the presence of a solution of a water-soluble high molecular weight material such as gelatin. Silver halides which can be used include silver chloride, silver bromide, as well as mixed silver halides such as silver chlorobromide, silver iodobromide or silver chlorobromoiodide.

The grains of these silver halides can have any of a cubic structure, an octagonal structure and a mixed structure thereof.

Two or more silver halide photographic emulsions which are separately prepared may be mixed. The crystal structure of the silver halide grains may be uniform throughout the grains, may have a layer structure in which the interior and outer portion are different, or may be the so-called conversion type grains as described in British Pat. No. 635,841 and U.S. Pat. No. 3,622,313. In addition, the silver halide grains may be the type forming a latent image mainly on the surface of the grains or the type forming a latent image in the interior of the grains, i.e., the internal latent image type. These photographic emulsions are described in the literature: C. E. K. Mees & T. H. James, *The Theory of the Photographic Process,* 3rd Ed., Macmillan, New York (1966); P. Grafkides, *Chimie Photographique,* Paul Montel, Paris (1957), etc. They can be prepared using various well known methods, such as the ammonia process, the neutral process or the acid process.

The above-described silver halide emulsions can be chemically sensitized using conventional techniques. Suitable chemical sensitizers which can be used include, e.g., gold compounds such as salts of chloroauric acid or auric trichloride as described in U.S. Pat. Nos. 2,399,083, 2,540,085, 2,597,856 and 2,597,915; salts of noble metals such as platinum, palladium, iridium, rhodium or ruthenium as described in U.S. Pat. Nos. 2,448,060, 2,540,086, 2,566,245, 2,566,263 and 2,598,079; sulfur compounds which react with a silver salt to form silver sulfide as described in U.S. Pat. Nos. 1,574,944, 2,410,689, 3,189,458 and 3,501,313; stannous salts as described in U.S. Pat. Nos. 2,487,850, 2,518,698, 2,521,925, 2,521,926, 2,694,637, 2,983,610 and 3,201,254; amines; and other reducing agents.

In some cases, various additives are preferably incorporated in the photographic element in order to obtain desired development characteristics, image characteristics or physical properties of the film. Examples of these additives include iodides (in the form of iodide salts) and organic compounds having a free mercapto group, such as phenylmercaptotetrazole or alkali metal iodides, but they are preferably not used in large amounts.

Anti-foggants which are usually incorporated in a photosensitive silver halide emulsion layer and a non-photosensitive auxiliary layer of the photographic element can be used in the invention.

In addition, hardeners, plasticizers, lubricants, surface agents, gloss agents and other additives known in the photographic art can be incorporated in the photographic element to which the method of this invention is applicable.

Hydrophilic colloids which can be used in the photographic element include, e.g., gelatin, colloidal albumin, casein, cellulose derivatives such as carboxymethyl cellulose or hydroxyethyl cellulose, saccharide derivatives such as agar, sodium alginate or starch derivatives, synthetic hydrophilic colloids such as polyvinyl alcohol, poly-N-vinyl pyrrolidone, polyacrylic acid copolymer or polyacrylamide, or the derivatives thereof or the partially hydrolyzed products thereof, etc. If desired, a compatible mixture of two or more of these hydrophilic colloids can be used. Of the above-described hydrophilic colloids, gelatin is most generally used. Gelatin can be, partially or completely, replaced with a synthetic high molecular weight material, and a so-called gelatin derivative can be used.

The photographic emulsions can be, if desired, spectrally sensitized or supersensitized using cyanine dyes such as cyanine, merocyanine or carbocyanine, individually or in admixture, or in combination with, e.g., styryl dyes. Such color sensitization techniques are well known and are described in, e.g., U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Patent Applications (OLS) Nos. 2,030,326 and 2,121,780, Japanese Patent Publications Nos. 4,936/68, 14,030/69 and 10,773/68, U.S. Pat. Nos. 3,511,664, 3,522,052, 3,527,641, 3,615,613, 3,615,632, 3,617,295, 3,635,721 and 3,694,217, British Pat. Nos. 1,137,580 and 1,216,203, etc. The techniques can be optionally selected depending upon the purpose and use application of the photosensitive material, that is, the wavelength region to be sensitized, the sensitivity desired and the like.

The photographic element to which the method of this invention is applicable comprises a support having thereon at least one silver halide emulsion layer. Usually, the element comprises a support having thereon a red-sensitive silver halide emulsion layer, a green-sensitive silver halide emulsion layer and a blue-sensitive silver halide emulsion layer, or the element comprises a support having thereon a red-sensitive silver halide emulsion layer containing a cyan image-forming coupler, a green-sensitive silver halide emulsion layer containing a magenta image-forming coupler and a blue-sensitive silver halide emulsion layer containing a yellow image-forming coupler. The photographic element can contain non-photosensitive photographic layers such as an antihalation layer, an intermediate layer for preventing color mixing, a yellow filter layer, a protective layer or an image-receiving layer. The order of the arrangement of the red-sensitive layer, the green-sensitive layer and the blue-sensitive layer is not particularly limited, and they can be arranged, e.g., in the order of the red-sensitive layer, the green-sensitive layer and the blue-sensitive layer, in the order of the blue-sensitive layer, the red-sensitive layer and the green-sensitive layer or in the order of the blue-sensitive layer, the green-sensitive layer and the red-sensitive layer, from the support. Moreover, the photographic element to which this invention is applicable can include elements in which one emulsion layer consists of plural unit emulsions as described in U.S. Pat. No. 3,726,681, British Pat. Nos. 818,687 and 923,045, U.S. Pat. No. 3,516,831 and Japanese Patent Applications Nos. 5,179/75 and 42,541/75; elements which have various layer constitutions; etc.

Suitable photographic supports which can be used include those which are usually used for photographic photo-sensitive materials, e.g., cellulose nitrate films, cellulose acetate films, cellulose acetate butyrate films, cellulose acetate propionate films, polystyrene films, polyethylene terephthalate films, polycarbonate films, laminates of these films, thin glasses, papers, etc. Satisfactory results can also be obtained with supports such as papers coated or laminated with baryta or a polymer of an $\alpha$-olefin, particularly, an $\alpha$-olefin having 2 to 10 carbon atoms, such as polyethylene, polypropylene or ethylene/butene copolymers, or synthetic resin films the surface of which has been matted to improve the adhesion with other high molecular weight materials as described in Japanese Patent Publication No. 19,068/72.

The supports can be transparent or opaque depending upon the purpose of use of the photosensitive material. With respect to transparent supports, colorless transparent supports and, in addition, transparent supports which are colored by incorporating a dye or a pigment therein can be used. The coloring of transparent supports has hitherto been practiced, e.g., for X-ray films and is also described in *J. SMPTE.*, 67, 296 (1958).

Opaque supports include those which are intrinsically opaque, for example, papers, as well as films prepared by adding a dye or a pigment such as titanium oxide to a transparent film, synthetic resin films having been surface treated in the manner as described in Japanese Patent Publication No. 19,068/72, and papers or synthetic resin films which are rendered completely light-shielding by the addition of carbon black, a dye, or the like. A layer having good adhesive properties to both of the support and the photographic emulsion layer can be provided as a subbing layer. Furthermore, for improving the adhesive properties, the surface of the support can be subjected to a pre-treatment such as a corona discharging, an ultraviolet irradiation or a flame treatment.

The photographic element to which this invention is applicable comprises a support having thereon dye-image supplying unit layers. Multi-color photographic elements have at least two of the above-described dye-image supplying unit layers, each of which is sensitive to a different wavelength range. The unit layer contains photosensitive silver halide which is spectrally sensitized in a specific spectral region and which is combined with a color coupler.

The layers of the photographic elements which are practically used in this invention can be coated using various coating methods including dip coating, air-knife coating, curtain coating, and extrusion coating in which a hopper as described in U.S. Pat. No. 2,681,294 is used.

The developer used in this invention contains one or more of the above-described various developing agents (reducing agents) and further can contain known additives for developers. The developer has a pH ranging from about 8 to 13 and includes additives such as an alkali agent, a pH buffer agent, etc. All of the above-described components for developer formulas which can be incorporated in the intensifier can be used in the developer.

In addition, the following compounds can be added to the color developer, if desired.

Competing couplers can also be incorporated in the color developer and examples include citrazinic acid, J-acid or H-acid as described in Japanese Patent Publications Nos. 9,505/69, 9,506/69, 9,507/69, 14,036/70 and 9,508/69 and U.S. Pat. Nos. 2,742,832, 3,520,690, 3,560,212 and 3,645,737.

Fogging agents such as alkali meta borohydrides, amineboranes or ethylenediamine as described in Japanese Patent Publication No. 38,816/72 can also be incorporated in the color developer.

Examples of compensating developing agents such as p-aminophenol, benzyl-p-aminophenol or 1-phenyl-3-pyrazolidone are those as described in Japanese Patent Publications Nos. 41,475/70, 19,037/71 and 19,438/71. The preferred amount of these compensating developing agents is considered usually about 0.1 to about 1.0 g/liter.

In one representative embodiment of this invention, silver halide color photosensitive materials are developed, intensified, bleached followed by fixing or bleach-fixed, washed and then dried to produce a color image. Alternatively, after intensification, the photosensitive materials can be washed and bleached.

In another embodiment, a developing agent is incorporated in an emulsion layer or an adjacent layer. The photosensitive materials are treated with the intensifier containing the compound of this invention to perform development and intensification at the same time without treating with a developer, then bleached followed by fixing or bleach-fixed, washed and then dried to produce a color image.

Moreover, in another embodiment, photosensitive materials containing a developing agent in the emulsion layer or adjacent layer are treated with the intensifier containing a fixing agent to perform development, intensification and fixing (a so-called monobath treatment), rinsed and then dried. In a modified embodiment, development, intensification and stabilization can be performed in a monobath processing with washing and rinsing being unnecessary.

In another embodiment, photosensitive materials can be developed, then intensified, fixed without bleaching, washed and then dried. This process is suitable for the processing of X-ray photosensitive materials.

When photosensitive materials containing, particularly, smaller amounts of silver are used, processing comprising development, intensification, washing and then drying can be employed.

Further, in another embodiment, couplers can be incorporated into a developer. Examples of diffusable couplers which are incorporated in the developer are, as cyan couplers, those as described in U.S. Pat. Nos. 3,002,836 and 3,542,552; as magenta couplers, those as described in Japanese Patent Publication No. 13,111/69; and as yellow couplers, those as described in U.S. Pat. No. 3,510,306. In this case, the couplers are used in concentrations of about 0.5 to about 5 g/liter, particularly 1 to 2.5 g/liter.

In color photographic systems, subtractive dye images can be formed using the color negative process as described in W. T. Hanson and W. I. Kesner, *Journal of the Society of Motion Picture and Television Engineers,* Vol. 61, pp. 667–701 (1953) or using color reversal processes in which a direct positive emulsion is employed or in which a reversal silver image is formed by the advantageous process in which a negative emulsion is employed and image-wise exposed to light, developed in a black-and-white developer to form a negative silver image, then exposed to light at least once more (or subjected to another suitable fogging treatment) and then developed again to form a desired subtractive colored dye image. In this case, bleaching is usually carried out after black-and-white development in order to prevent the first developed silver from acting as a catalyst, and the intensifying step is conducted after color development.

Although the processing of this invention can be carried out at any temperature, the process is usually done at about 10° C. to about 70° C., particularly 20° C. to 60° C.

The process of this invention is excellent and some of the advantages thereof as compared with the conventional processes are set forth below.

First, since metal nuclei, typically silver, act merely as a redox catalyst, only a very small amount is effective. Therefore, the amount of metal or metal salts used, such as silver, can be markedly decreased.

Secondly, the image-intensification of this invention can provide considerably higher intensifying effect, as compared with the conventional intensification using cobalt (III) complex salts (e.g., as described in U.S. Pat. No. 3,826,652, etc.).

Thirdly, a high intensification effect is retained to a greater extent as compared with conventional intensification using peroxides. The photosensitive material of this invention is not adversely affected by intensification inhibitors. Also, even when the components used for a developer are carried over into the intensifier of this invention, the decomposition of peroxides such as hydrogen peroxide is not accelerated. Thus, remarkably high intensification effect is retained. That is to say, the processing running stability can be considerably increased.

Fourthly, images which show markedly less fog and less color mixing can be obtained as compared with the conventional intensification by peroxides.

Fifthly, the peroxide compound used in this invention is inexpensive as compared with the intensification using cobalt (III) complexes and, therefore, the treatment can be carried out economically.

Sixthly, such problems in environmental pollution due to discharge of waste liquids as is encountered in cobalt intensification does not occur at all. The organic phosphonic acid compounds used in this invention are present in the processing solution in a usual manner. They are easily decomposed by reaction with a sulfite or a thiosulfate.

The following examples are given to illustrate this invention in more detail without, however, intending to limit the embodiments of this invention thereto. Unless otherwise indicated herein, all parts, percents, ratios and the like are by weight.

EXAMPLE 1

A photographic material having the following elements (1) to (7) was prepared.

(1) A paper support coated with polyethylene.

(2) A layer of a blue-sensitive silver chlorobromide emulsion (silver chloride: 20 mole%) containing 150 mg/m$^2$ of silver, 1,500 mg/m$^2$ of gelatin and 600 mg/m$^2$ of a yellow coupler, i.e., α-pivaloyl-α-(2,4-dioxo-5,5-dimethyloxazolidin-3-yl)-2-chloro-5-[α-(2,4-di-t-amylphenoxy)butanamido]acetanilide dispersed in 300 mg/m$^2$ of dioctylbutyl phosphate.

(3) A layer containing 1,000 mg/m$^2$ of gelatin.

(4) A layer of a green-sensitive silver chlorobromide emulsion (silver chloride: 70 mole%) containing 100 mg/m$^2$ of silver, 800 mg/m$^2$ of gelatin and 350 mg/m$^2$ of a magenta coupler, i.e., 1-(2,4,6-trichlorophenyl)-3-[(2-chloro-5-tetradecanamido)anilino]-2-pyrazolin-5-one dispersed in 170 mg/m$^2$ of tricresyl phosphate.

(5) A layer containing 1,000 mg/m$^2$ of gelatin, 700 mg/m$^2$ of an ultraviolet absorber and 50 mg/m$^2$ of di-octylhydroquinone.

(6) A layer of a red-sensitive silver halide emulsion (silver chloride: 70 mole%) containing 100 mg/m$^2$ of silver, 700 mg/m$^2$ of gelatin and 300 mg/m$^2$ of a cyan coupler, i.e., 2-[α-(2,4-di-t-amylphenoxy)-butanamido]-4,6-dichloro-5-methylphenol dispersed in 150 mg of n-dibutyl phthalate.

(7) A layer containing 1,000 mg/m$^2$ of gelatin.

Two types of photographic materials, i.e., Sample A comprising the elements (1) to (7) above and Sample B which was prepared in the same manner as Sample A except for the incorporation of 400 mg/m$^2$ of the Compound (4) described hereinbefore in the green-sensitive silver halide emulsion layer, were prepared.

The photographic materials were exposed to light using a sensitometer and then subjected to the following processings.

| Processing Steps | Temperature (°C.) | Time |
|---|---|---|
| Color Development | 40 | 1 min |
| Intensification | 40 | 1 min |
| Washing | 26 | 30 sec |
| Bleach-Fixing | 40 | 1 min |
| Washing | 26 | 1 min 30 sec |
| Drying | | |

The processing solutions used had the following compositions.

| | |
|---|---|
| **Color Developer** | |
| Benzyl Alcohol | 15 ml |
| Potassium Carbonate | 30 g |
| Potassium Bromide | 0.4 g |
| Hydroxylamine Sulfate | 2 g |
| Potassium Sulfite | 4 g |
| Diaminopropanol Tetraacetic Acid | 3 g |
| N-Ethyl-N-methoxyethyl-3-methyl-p-phenylenediamine Di-p-toluenesulfonate | 7.5 g |
| Water to make | 1 l (pH 10.1) |
| **Intensifier** | |
| Hydrogen Peroxide (30% aq. soln.) | 30 ml |
| Sodium Carbonate (monohydrate) | 20 g |
| 5-Methylbenzotriazole | 100 mg |
| Water to make | 1 l (pH 10.0) |

The following four intensifiers were prepared by adding additives to the above intensifier as set forth in Table 1 below.

Table 1

| Intensifier No. | Additive | Amount Added |
|---|---|---|
| 1 | None | — |
| 2 | Sodium pyrophosphate | 2 g/l |
| 3 | Sodium stannate | 100 mg/l |
| 4 | Compound M | 2 mg/l |

Intensifier Nos. 1 to 3 were used for comparison, and Intensifier No. 4 is of this invention.

| | |
|---|---|
| **Bleach-Fixing Solution** | |
| Ammonium Thiosulfate (70% aq. soln.) | 150 ml |
| Sodium Sulfite | 5 g |
| Na[Fe(EDTA)] | 40 g |
| EDTA | 4 g |
| Water to make | 1 l |

The photographic characteristic values obtained are shown in Table 2 below. Next, Intensifier Nos. 1 to 4 described above were contaminated with 10% of the color developer described above and then allowed to stand at 40° C. for 4 days. Then, the same processings as described above were carried out for each of the intensifiers thus obtained. The photographic characteristic values obtained are shown in Table 2 below.

TABLE 2

| | Run* No. | Fresh Solution | | | | | | | | Contaminated Solution | | | | | | | |
|---|---|---|---|---|---|---|---|---|---|---|---|---|---|---|---|---|---|
| | | Fog | | | Maximum Density | | | Color Mixing | | Fog | | | Maximum Density | | | Color Mixing | |
| | | R | G | B | R | G | B | R/G | B/G | R | G | B | R | G | B | R/G | B/G |
| Sample A | | | | | | | | | | | | | | | | | |
| | 1 | 0.11 | 0.11 | 0.16 | 2.22 | 1.03 | 1.56 | 0.05 | 0.06 | 0.12 | 0.12 | 0.15 | 1.96 | 0.87 | 1.48 | 0.04 | 0.08 |
| | 2 | 0.11 | 0.11 | 0.16 | 2.28 | 1.18 | 1.83 | 0.05 | 0.07 | 0.12 | 0.12 | 0.16 | 2.18 | 1.18 | 1.53 | 0.04 | 0.07 |
| | 3 | 0.11 | 0.12 | 0.17 | 2.31 | 1.23 | 1.81 | 0.04 | 0.07 | 0.12 | 0.11 | 0.16 | 2.30 | 1.23 | 1.58 | 0.04 | 0.07 |
| | 4 | 0.12 | 0.12 | 0.16 | 2.63 | 1.94 | 1.95 | 0.03 | 0.03 | 0.11 | 0.12 | 0.16 | 2.47 | 1.40 | 1.69 | 0.03 | 0.04 |
| Sample B | | | | | | | | | | | | | | | | | |
| | 1 | 0.12 | 0.12 | 0.18 | 2.46 | 2.16 | 2.10 | 0.05 | 0.07 | 0.12 | 0.12 | 0.15 | 1.64 | 0.90 | 1.40 | 0.09 | 0.12 |
| | 2 | 0.12 | 0.12 | 0.19 | 2.51 | 2.23 | 2.13 | 0.04 | 0.07 | 0.12 | 0.13 | 0.21 | 2.21 | 1.83 | 1.82 | 0.08 | 0.11 |
| | 3 | 0.12 | 0.12 | 0.19 | 2.54 | 2.31 | 2.14 | 0.03 | 0.05 | 0.12 | 0.13 | 0.21 | 2.35 | 1.95 | 1.86 | 0.07 | 0.10 |
| | 4** | 0.12 | 0.12 | 0.18 | 2.60 | 2.40 | 2.16 | 0.00 | 0.00 | 0.12 | 0.12 | 0.19 | 2.62 | 2.36 | 2.17 | 0.01 | 0.01 |

*Run No. corresponds to Intensifier No. set forth in Table 1.
**Intensifier of this invention. Others are included for comparison. Sample B contained Compound (3) used in this invention.

In Table 2 above, the effect of preventing color mixing is expressed in R/G and B/G. The lower the value, the less the color mixing. The R/G and B/G are relative values which were obtained by the red density (R) and the blue density (B) at the exposure amount which provided a green density of 1.5 in the green-exposed areas, dividing the red density (R) and the blue density (B) by 1.5, respectively, and subtracting, from the red density/1.5 (or the blue density/1.5), the red density/1.5 (or the blue density/1.5) of Sample B which contained Compound 4 incorporated into the photosensitive material and which was treated with the fresh solution. When the green density did not reach 1.5, the values at its maximum density were used.

As is shown by the results in the above Table 2, Sample B containing Compound 4 in the photosensitive material formed an image having a higher maximum density even when treated with the contaminated solution.

Moreover, Run No. 4 which used Intensifier No. 4 containing Compound M gave a higher image density and less color mixing.

While the invention has been described in detail and with reference to specific embodiments thereof, it will be apparent to one skilled in the art that various changes and modifications can be made therein without departing from the spirit and scope thereof.

What is claimed is:

1. A method of preventing color mixing and forming an image in an image-wise exposed silver halide color photographic element including color development and simultaneously or subsequently thereto intensification; said element comprising a support and at least one color sensitive emulsion layer containing a color coupler and said element containing at least one compound having a degree of polymerization of about 10 to about 8,000 and represented by the following general formula (I):

$$\text{-}(A)_x(B)_y\text{-} \quad \text{(I)}$$

wherein:

A represents $$\text{-}(CH_2\text{-}\underset{\underset{R}{|}}{CH})\text{-}$$

or $\text{-}(CH_2\text{-}CH_2\text{-}O)\text{-}$, R represents

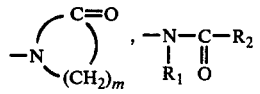

or —OH, m is an integer of 3 to 7, $R_1$ represents an alkyl group having 1 to 6 carbon atoms, $R_2$ represents a hydrogen atom or an alkyl group having 1 to 4 carbon atoms;

B represents a monomer unit derived from styrene, methacrylate acid ester, acrylic ester, vinyl ester, acrylonitrile, vinyl alcohol, vinyl chloride, vinyl ether, acrylamide, N,N-dimethylacrylamide, acrylic acid, methacrylic acid, maleic acid, potassium styrenesulfonate, N,N-dialkylaminoalkyl methacrylate, vinylimidazole or vinylpyridine; and x and y represent the mole %, respectively, of A and B, where $x + y = 100$ with $x \geqq 30$;

said intensification performed using a solution element to an image-intensifying performed using a solution containing (1) at least one peroxide selected from the group consisting of hydrogen peroxide and compounds capable of releasing hydrogen peroxide and (2) 10 mg to 50 g/liter of at least one organic phosphonic acid compound represented by the general formula (II) or (III):

$$R_1N(CH_2PO_3M_2)_2 \quad \text{(II)}$$

wherein M represents a hydrogen atom or a water-solubilizing cation, $R_1$ represents an alkyl group having 1 to 4 carbon atoms, an aryl group, an aralkyl group, an alicyclic group, or a heterocyclic group, in which $R_1$ can be substituted with one or more of a hydroxy group, an alkoxy group, a halogen atom, $—PO_3M_2$, $—CH_2PO_3M_2$ or $—N(CH_2PO_3M_2)_2$, wherein M has the same meaning as described above;

$$R_2R_3C(PO_3M_2)_2 \quad \text{(III)}$$

wherein $R_2$ represents a hydrogen atom or an alkyl group, an aralkyl group, an alicyclic group or a heterocyclic group as defined above for $R_1$, $—CHR_4—PO_3M_2$ wherein $R_4$ represents a hydrogen atom, a hydroxy atom or an unsubstituted alkyl group or $—PO_3M_2$, wherein M is as defined above, $R_3$ represents a hydrogen atom, a hydroxyl group, an alkyl group which may be substituted as described for the alkyl group for $R_1$ or $—PO_3M_2$, wherein M has the same meaning as described above.

2. The method of claim 1, wherein said silver halide photographic element additionally contains a color coupler and said method includes developing said image-wise exposed silver halide photographic element and then subjecting said element to said image-intensifying in the presence of a p-phenylenediamine derivative color developing agent with said solution containing said peroxide (1) and said organic phosphonic acid compound (2).

3. The method of claim 1, wherein said compound represented by the general formula (I) is

| | |
|---|---|
| 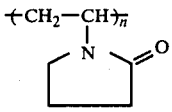 | (n: 100 - 150) |
| 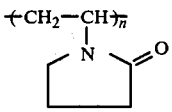 | (n: 300 - 500) |
| 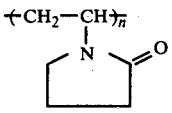 | (n: 2,000 - 3,000) |
| 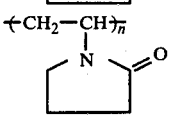 | (n: 5,000 - 8,000) |
| 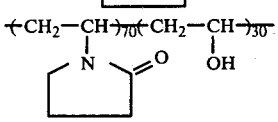 | (degree of polymerization: 200 - 250) |
| 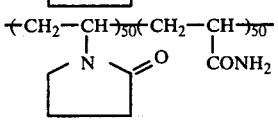 | (degree of polymerization: 200 - 250) |

4. The method of claim 1, wherein said phosphonic acid compound is:

ethylenediamine-N,N,N',N'-tetramethylenephosphonic acid,
nitrilo-N,N,N-trimethylenephosphonic acid,
1,2-cyclohexanediamine-N,N,N',N'-tetramethylenephosphonic acid,
o-carboxyaniline-N,N-dimethylenephosphonic acid,
propylamine-N,N-dimethylenephosphonic acid,
4-(N-pyrrolidino)butylamine-N,N-bis(methylenephosphonic acid),
1,3-diaminopropanol-N,N,N',N'-tetramethylenephosphonic acid,
1,3-propanediamine-N,N,N',N'-tetramethylenephosphonic acid,
1,6-hexanediamine-N,N,N',N'-tetramethylenephosphonic acid,
o-acetamidobenzylamine-N,N-dimethylenephosphonic acid,
o-toluidine-N,N-dimethylenephosphonic acid,
2-pyridylamine-N,N-dimethylenephosphonic acid,
1-hydroxyethane-1,1-diphosphonic acid,
ethane-1,1,1-triphosphonic acid,
1-hydroxy-2-phenylethane-1,1-diphosphonic acid,
2-hydroxyethane-1,1-diphosphonic acid,
1-hydroxyethane-1,1,2-triphosphonic acid,
2-hydroxyethane-1,1,2-triphosphonic acid,
ethane-1,1-diphosphonic acid, or
ethane-1,2-diphosphonic acid.

5. The method of claim 1, wherein said peroxide is hydrogen peroxide, a perhydrate, a peroxocarbonate, a peroxoborate, a peroxosulfate or a peroxophosphate.

6. The method of claim 1, wherein said compound having the general formula (I) is present in said silver halide photographic element in an amount of about 1 mg to about 10 g per $m^2$ of said photographic element; said organic phosphonic acid compound is present in an amount of about 10 mg to about 50 g per liter of said solution, said peroxide is present in an amount of about 1 g to about 300 g per liter of said solution, and the pH of said solution ranges from about 7 to about 14.

7. The method of claim 1, wherein said reducing agent is a compound which upon oxidation forms a dye per se, a compound which upon oxidation then oxidatively couples with a color coupler having a coupling capability to form a dye, a compound having a diffusible dye moiety capable of being image-wise oxidized and thereby rendered non-diffusible or a compound containing a non-diffusible color coupler moiety having a coupling capability and capable of being image-wise oxidized to release a diffusible coupler.

8. The method of claim 1, wherein said reducing agent is a p-phenylenediamine derivative color developing agent, a p-aminophenol derivative color developing agent capable of forming an onium salt, a dye developing agent, a diffusible-dye releasing redox compound, a developing agent which forms a dye upon reaction with an amidrazone compound, a reducing agent capable of being oxidized to form a dye or a lake or a reducing agent capable of forming a color image after oxidation thereof.

9. The method of claim 1, wherein said photographic material contains an image-wise distributed material having a catalytic action.

10. The method of claim 1, wherein said method includes image-wise exposing said silver halide photographic element, developing said image-wise exposed photographic element with a reducing agent to form silver images and then subjecting the photographic element to said image intensifying.

* * * * *